United States Patent [19]

Penven

[11] Patent Number: 4,883,096

[45] Date of Patent: Nov. 28, 1989

[54] SEAM DESIGN FOR SEAMED FELTS

[75] Inventor: Patrick H. Penven, Clinton, S.C.

[73] Assignee: Asten Group, Inc., Charleston, S.C.

[21] Appl. No.: 190,136

[22] Filed: May 4, 1988

[51] Int. Cl.[4] ..... D03D 3/04

[52] U.S. Cl. ..... 139/383 A

[58] Field of Search ..... 139/383 A, 383 AA; 162/348, 358, DIG. 1; 24/33 P; 28/141

[56] References Cited

U.S. PATENT DOCUMENTS

| | | | |
|---|---|---|---|
| 2,883,734 | 4/1959 | Draper Jr. . | |
| 2,907,093 | 10/1959 | Draper Jr. . | |
| 3,283,388 | 11/1966 | Kelleher et al. . | |
| 3,309,790 | 3/1967 | MacBean . | |
| 3,815,645 | 6/1974 | Codorniu . | |
| 4,026,331 | 5/1977 | Lees et al. . | |
| 4,123,022 | 10/1978 | Dutt et al. . | |
| 4,141,388 | 2/1979 | Romanski et al. . | |
| 4,186,780 | 2/1980 | Josef et al. . | |
| 4,364,421 | 12/1982 | Martin . | |
| 4,401,137 | 8/1983 | Cannon . | |
| 4,438,788 | 3/1984 | Harwood | 139/383 A |
| 4,500,590 | 2/1985 | Smith . | |
| 4,658,863 | 4/1987 | Errecart | 139/383 A |
| 4,683,624 | 8/1987 | Dufour . | |

FOREIGN PATENT DOCUMENTS

| | | | |
|---|---|---|---|
| 982682 | 2/1965 | United Kingdom . | |
| 2178766 | 2/1987 | United Kingdom | 139/383 A |

*Primary Examiner*—Henry S. Jaudon

*Attorney, Agent, or Firm*—Volpe and Keonig

[57] ABSTRACT

An improved loop construction for use in closing the ends of an open papermaker's fabric is disclosed. The loop constuction, as disclosed, is elongated to achieve a minimum loop length of at least three millimeters. The loop is formed by an arcuate portion which defines the free end of the loop and adjacent portions which are interwoven with the fabric body in a repeated pattern. As a result of the disclosed construction, the continuous arcuate portion of the seaming loop is positioned vertically with respect to a plane through the horizontal plane of the fabric. The continuous arcuate portion of the loop is within 15° of the perpendicular to the horizontal plane of the fabric.

3 Claims, 3 Drawing Sheets

FIG. 4
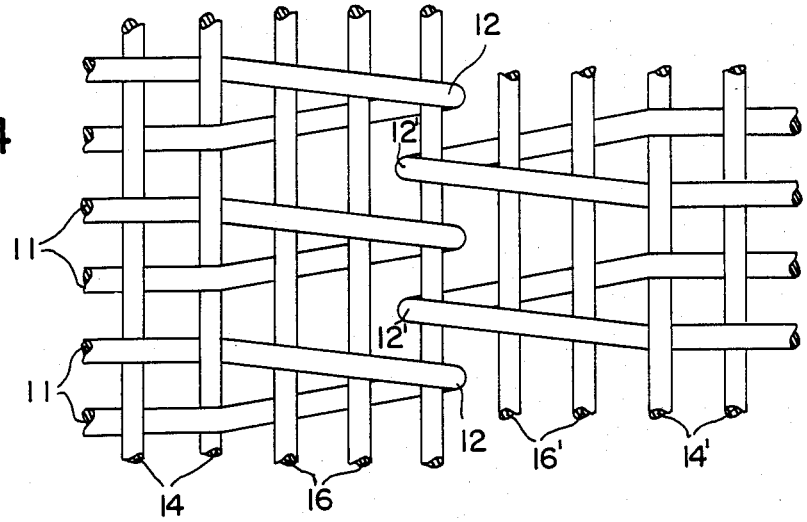
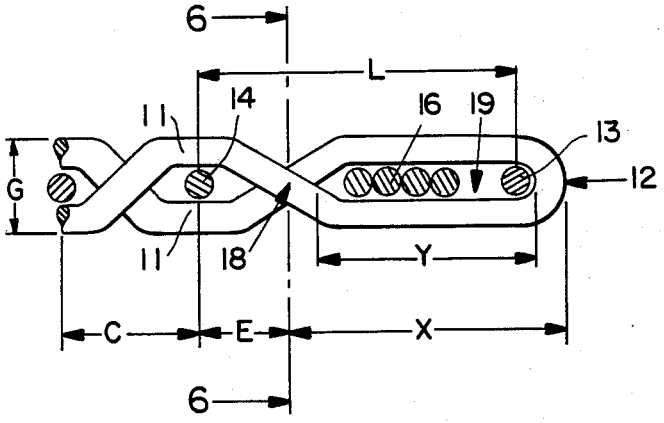
FIG. 5
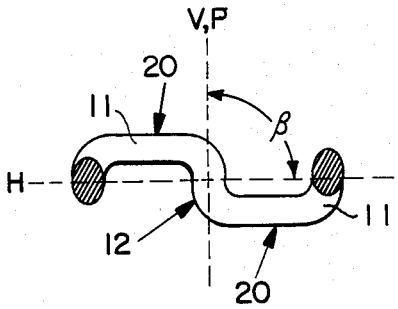
FIG. 6
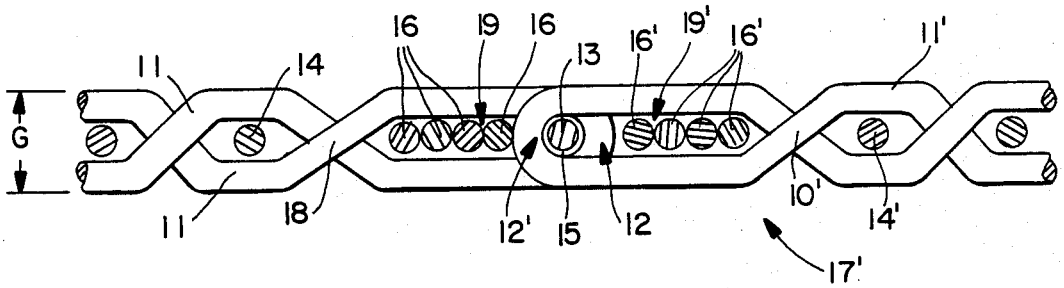
FIG. 7

SEAM DESIGN FOR SEAMED FELTS

FIELD OF THE INVENTION

This invention relates generally to a joint construction for a papermakers fabric. More particularly, the invention relates to pintle seamed joints for papermakers wet press felts.

BACKGROUND OF THE INVENTION

In conventional papermaking machines, wet felts convey the sheet of paper, paperboard, etc., from the wire or cylindrical mold thrugh various water removing equipment.

Such wet felts are often woven endless and are applied as such to the rolls of the papermaking machine. The installation of endless wet felts in the past has required cessation of operations for extended periods of time with the resultant loss of production from the paper machine.

Recent developments have resulted in greater use of seamed press felts which are joined or seamed by a pintle to simulate the endless condition. This construction is generally described as a pintle seamed joint. The inability to produce a pintle seamed joint geometry which does not differ substantially from the plane of the fabric body has been a major fault with this newer construction.

In view of the prior failures, the present invention teaches the use of an extended loop in the seam area. Although this is occasionally contrary to the prior art theory of continuing the same weave or float length through the fabric seam area, the invention permits greater control over the seam configuration and, in fact, results in a more uniform fabric geometry at the seam.

U.S. Pat. 2,883,734 provided a wet felt of a woven open-ended strip construction which was made endless by joining together the extensions of yarn from the weave of the felt at the joining ends thereof. One end of the wet felt is fed through the dryer section of the machine, until it completes a full loop. The yarn extensions at the joining ends of the felt are continuous with the weave system thereof and are used for joining together the two ends of the felt, and a textile yarn or cord is used to secure both sets of yarn extensions together and retain the two ends of the felt connected together to form an endless belt structure. Thus, the wet felt is installed without having to disassemble the machine.

The art is replete with descriptions of seam constructions for papermakers felts; see for example the disclosures of U.S. Pat. Nos. 2,883,734; 3,283,388; 3,309,790; 4,123,022; 4,141,388; 4,186,780 and 4,364,421. In general, the seam constructions of the prior art have not been entirely satisfactory for all purposes and applications.

U.S. Pat. No. 4,500,590 issued Feb. 19, 1985 to Smith, attempts to solve this problem via a composite pintle including a polyester core and an outer low-melt polymeric sheath which has been softened and deformed. This composite pintle exhibits a profile which occupies void areas in the mesh of the helical fabric in the area of the pintle joint.

The difficulty in establishing overall uniformity between the caliper of the fabric and the caliper of the seam has been recognized in the prior art. Likewise, it has been recognized, in the prior art, that the normal construction of a single layer fabric results in a fabric thickness which is less than three times the yarn diameters, due to the crimp introduced into the yarns and a seam thickness which is about three yarn diameters. For example, a single layer fabric of normal construction, having monofilament warp threads and weft threads, would typically have a thickness which is only two and a half times the yarn diameter, rather than three times the yarn diameter as may be expected. This condition is discussed in detail in U.S. Pat. No. 4,026,331 which is incorporated herein by reference as if fully set forth. As recognized in U.S. Pat. No. 4,026,331, one approach to controlling equality between seam thickness and fabric thickness is to select certain weaves and cover factors which will permit equalization and uniformity of overall fabric caliper. However, such an approach eliminates many desirable weave constructions and fabrics which do not have the requisite percentage of warp cover or met the weave limitations. Accordingly, the present invention sets forth a structure which will accomplish the goals of U.S. Pat. No. 4,026,331 without the inherit limitations thereof.

DESCRIPTION OF THE DRAWINGS

FIG. 4 is a plan view of the seam according to the instant invention. The weave repeat of the fabric is the same as that shown in prior art FIG. 1.

FIG. 5 is a side elevation, similar to FIG. 2, of a construction according to the present invention.

FIG. 6 is a section view taken along the line 6—6 of FIG. 5.

FIG. 7 illustrates the construction of FIG. 5 in a closed seam and also includes differential cross hatching to indicate removable yarns.

DESCRIPTION OF THE PREFERRED EMBODIMENT

The terms machine direction and cross machine direction as used herein refer to the fabric orientation on the papermaking machine rather than in the loom.

Figure 1:
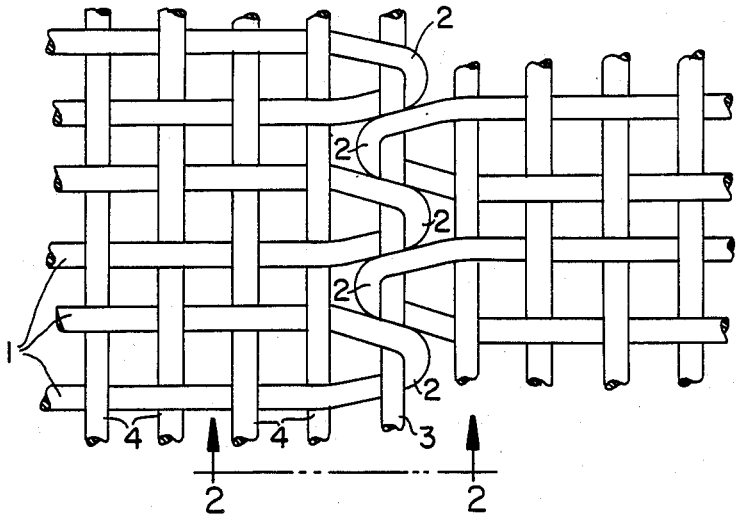
FIG. 1 PRIOR ART
FIG. 1 is a top plan view of a prior art construction.

FIG. 1 is a portion of a prior art seam construction in a woven fabric which includes a plurality of machine direction yarns 1 interwoven with a plurality of cross machine direction yarns 4. In order to seam the fabric, a plurality of integral contiguous seaming loops 2 are formed at each terminal end of the woven fabric. The seaming loops 2 are formed using techniques known in the art. To place the fabric in service, loops from each end of the fabric are intermeshed to form a channel and a pintle, such as 3, is inserted to retain the fabric ends together in a substantially continuous, endless structure.

Figure 2:
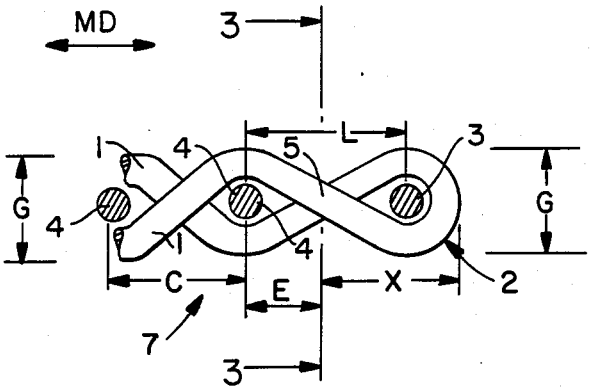
FIG. 2 PRIOR ART
FIG. 2 is a side elevation taken from the view 2—2 of FIG. 1.
Figure 3:
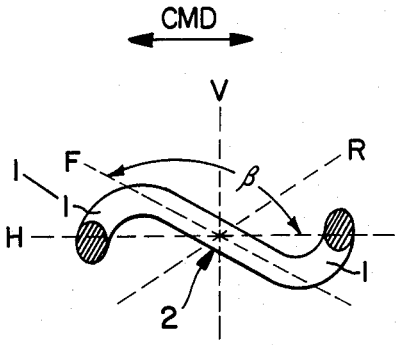
FIG. 3 PRIOR ART
FIG. 3 is a section taken through the line 3—3 of FIG. 2.

With reference to FIGS. 2 and 3, the prior art construction will be explained in more detail. It will be understood by those skilled in the art that yarns 1 and 4 will generally have some crimp and that the loop 2 and pintle 3 will generally not have the same degree of crimp. Thus, the FIGS. are only illustrative of the weave. As shown in FIG. 2, the machine direction yarn 1 is looped, reversed and passed in a mirror image weave with the end cross machine direction yarn 4. This may be done after weaving of the fabric in a subsequent operation or at the time of weaving if the weaving is preformed on an endless loom. The machine direction yarn 1 forms a crossover 5 and a loop 2. The loop 2 is a continuous arcuate portion of the same machine direction yarn 1. The center to center distance between the last cross machine direction yarn 4 and the pintle 3 in the eye of loop 2 defines the loop length and is designed L. The distance X indicates the overall free length of the loop 2 from the center of the crossover 5. The distance E indicates the portion of the loop length L from crossover 5 to the last cross machine drection yarn 4. The distance c is the length between cross machine direction yarns 4 in the fabric weave repeat.

The above prior art seam construction, which is in accordance with the prior theory, is deficient in that the distance E is equal to about one-half the distances L and X. The free loop length X is substantially equal to the distance C between cross machine direction yarns 4. This results in the loop 2 being formed substantially in the repeat pattern of the weave as was consistent with the prior art thinking. Utilization of this prior art construction renders it almost impossible to achieve the same fabric gauge or caliper G in the body of the fabric and at the loop or seam area. If the pintle 3 is of the same size as the cross machine direction yarn 4, the gauge or caliper at the loop 2 will be larger. If the pintle 3 is reduced in size, in an effort to decrease the loop gauge or caliper, the loop forming machine direction yarn will be under less control and will tend to rotate in the horizontal plane of the fabric due to axial forces in the yarn 1. Thus, all efforts to bring the gauge of the fabric and the seam area into equality require compromises in the form and structure of the loops 2. This relationship is further explained hereinafter.

FIG. 3 is a partial view of the forward section of the machine direction yarn 1 along the line 3—3 of FIG. 2. The plane line F indicates a plane along the longitudinal axis of the section of the yarn forming loop 2. Loop 2 is a continuous arcuate portion of yarn 1 as it is reversed on itself and woven back into the fabric. The plane line R indicates a plane along the longitudinal axis of what would be the opposing yarn forming a loop 2 and shows that it is a mirror image of the opposed yarn. The plane H indicates the horizontal plane of the woven fabric through the center or eye of loop 2 and the fabric. The plane v indicates the vertical plane perpendicular to plane H. The angle between the longitudinal axis F of the loop 2 and the horizontal plane H is identified as $\beta$.

The obtuse angle $\beta$ is directly related to the distances L and X and their relationship to E. As X approaches E, the distance L is decreased. As L decreases the axial forces on the yarn 1 and loop 2 are increased. The increased axial forces tend to rotate the arcuate portion of loop 2 closer to the plane H and thereby increase the angle $\beta$.

It has been found that in order to eliminate or substantially reduce axial tension and to have the angle $\beta$ approach, as closely as possible 90°, the difference between the distances L and X should be decreased and the differences between L and X with respect to E should be increased.

In a preferred embodiment of the invention, FIG. 4, the base fabric weave is the same as that of prior art FIG. 2. The machine direction yarn 11 extends over the end cross machine direction yarn 14, forms an elongated loop 12 and weaves back into the fabric in a mirror image. With reference to FIG. 5, this produces crossover 18 and the loop 12. The loop length L, as shown, is elongated and substantially greater than in the prior art. In this embodiment, it is elongated by at least three times the average diameter of the cross machine direction yarns. In any event, the elongated loop length L is always at least 3 mm. As illustrated, L is about four and a half times the average cross machine direction yarn diameter plus one-half of the pintle and the diameter of the opposing machine direction yarn. Accordingly, an elongated aperture 19 is created between the free end of the loop 12 and the contiguous fixed end thereof at crossover 18. Aperture 19 always has a length Y which is at least three times the average diameter of the cross machine direction yarn 14. As illustrated, a number of stuffers 16 are inserted in the aperture or channel 19 between the pintle 13 and the crossover 12. The remaining space in between the stuffers and the pintle accommodates the corresponding loop from the opposite end of the fabric. The addition of the stuffers 16 aids in physically maintaining the geometry of the loop 12 at almost the 90° position. This relationship will be discussed in more detail hereinafter.

Generally, the more stuffers that can be inserted, the easier it becomes to form the optimum 90° angle. That is, the lengths L and X come closer together and the arcuate portion of the loop 12 will more nearly approximate 90°. Likewise, the distances Y and X approach each other with the difference ideally approaching the diameter of the yarn 11.

FIG. 6 is a partial view of the machine direction yarn 11 along the line 6—6 in FIG. 5 and is comparable to FIG. 3. The angle $\beta$ indicates the angle from the plane H to the vertical plane v of the machine direction yarn at the crossover 18. To obtain the best results, the angle $\beta$ should approximate 90°. The longitudinal axis of the arcuate portion of the yarn forming loop 12, as indicated by the plane line F, is brought into coincidence with the vertical plane v. Note also that the portions 20 of the machine direction yarn adjacent to the arcuate portion of the loop 12 extend toward the body of the fabric in a more horizontal orientation than in the prior art and are generally more parallel to the plane H. Thus, it can be seen that the elongated loop has reduced the axial tension and the tendency of the loop forming yarn to rotate into the horizontal plane H of the fabric.

With respect to formation of the loop and the utilization of stuffer 16, it will be appreciated by those skilled in the art that insertion of stuffers 16 will tend to minimize collapsing of the loop and to resist rotation into the horizontal plane.

In general, the desired elongated loop may be formed by placing the machine direction yarns under tension. However, the application of tension to the fabric in the machine direction will often result in crimp interchange and shifting of the cross machine direction yarns. The use of a loop forming mandrel of the desired elongated geometry may be used to form the loop. Alternatively, the stuffers may be utilized to preserve the weave structure and to prevent loop crushing. In addition, utilization of stuffers enables a loop structure having a gauge or caliper which is substantially identical to that of the fabric. As noted previously, utilization of a smaller diameter pintle wire will reduce loop caliper. Although the elongated loop will not have the same rotational tendencies of the prior art loop, the stuffers help to maintain fabric caliper throughout the length of the elongated loop. By selecting stuffers which have an average diameter which is less than that of the cross machine direction yarns, it is possible to compensate for the crimp in the fabric weave and to obtain substantially the same caliper throughout the fabric and seam area. Furthermore, stuffers reduce the amount of tension which is required to preserve the elongated loop and ease in manufacturing of the base fabric. Stuffers present additional advantages which will be discussed in more detail hereinafter.

In FIG. 7, the seam is shown in the completed form without a batt on the base fabric. The prime numbers indicate the identical counterparts of the opposing end of the woven fabric. Still with reference to FIG. 7, it will be noliced that alternate stuffers among the stuffers 16 and 16' are shown with different cross hatching than in the prior figures. The differential cross hatching illustrated a construction in which certain of the stuffer yarns do not form part of the final running felt. Accordingly, selected stuffers are comprised of removable yarns. In the preferred embodiment, the removable stuffers are dissolving yarns, such as Solvron two-ply which is available from Hickory, N.C. In an alternative embodiment of the invention, fusible yarns are used in place of the soluble yarns. Thus, with reference to FIG. 7, the stuffer yarns 16 would be fusible yarns, such as fusible Wonder Thread monofilament nylon which is available from the Shakespeare Company in Columbia, S.C.

At present, soluble yarns are preferred as the removable yarns due to their ability to be removed after installation of the felt on the papermaking equipment. The soluble yarns may be retained in the finished manufactured felt to preserve loop geometry. After the fabric is installed and placed under tension, the yarns are dissolved from the felts. Since it is desirable to have the option of removing the yarns during the manufacturing or at the installation, soluble yarns are preferred.

With the use of fusible or meltable yarns in the alternative embodiment, the felt after the needling of batt 20 thereto is subjected to the yarn manufacturers suggested temperature and pressure in order to melt or remove the fusible yarns 16. As a result of the melting operation, the fusible yarns will be dispersed throughout the felt and voids in the seam structure will be created as is shown in FIGS. 9 and 10.

Figure 8:
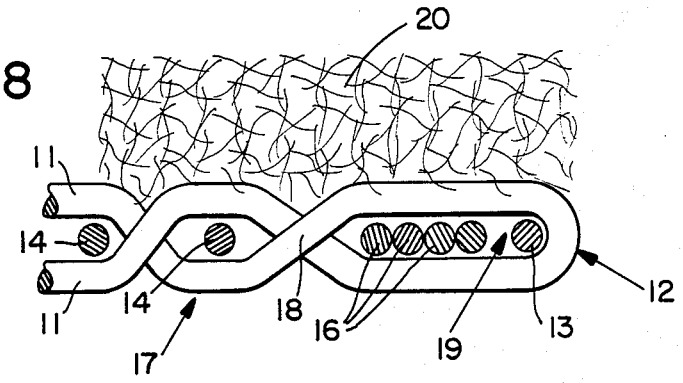
FIG. 8 illustrates one half of the construction depicted in FIG. 7 with a batt needled to the base fabric.

FIG. 8 shows the seam construction of FIG. 3 with a batt 20 thereon. The batt can be needled into the stuffers 16 in the same manner as with the cross machine direction yarns 4. This enables the batt to be strongly anchored to the seam. In addition, the stuffers provide control over differences in the permeability and density between the seam area and the woven fabric.

Figure 9:
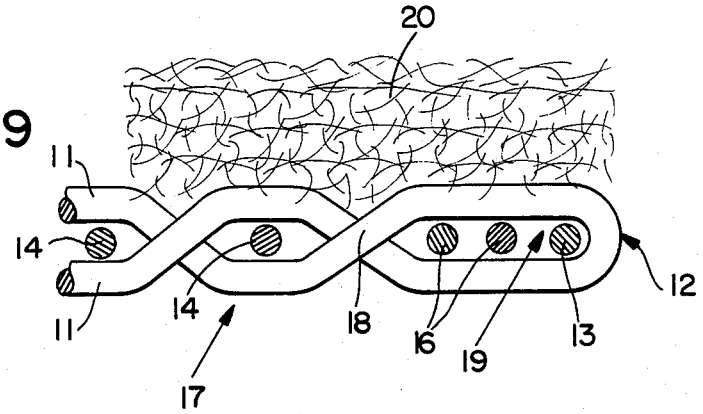
FIG. 9 illustrates the construction of FIG. 8 after removal of selected stuffer yarns.
Figure 10:
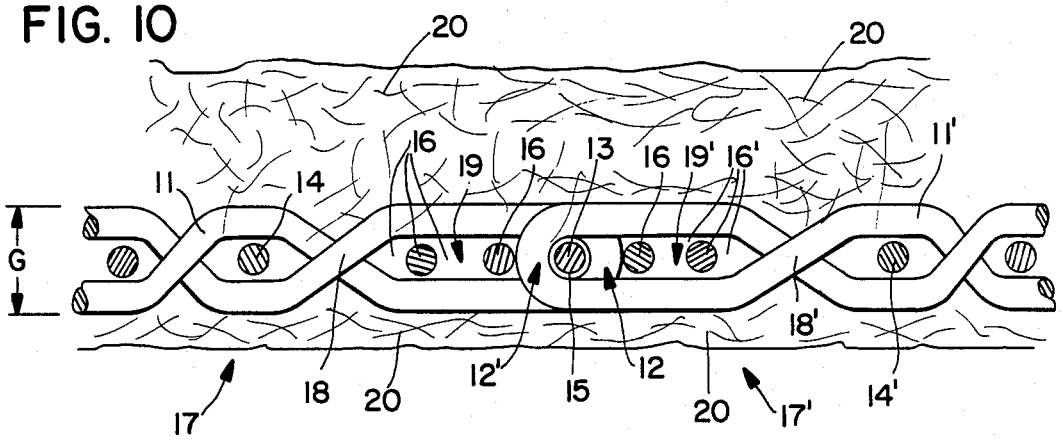
FIG. 10 illustrates a construction similar to FIG. 9 after the fabric seam has been closed and for a fabric with batt needled to both sides of the fabric.

FIGS. 9 and 10 illustrate the construction of FIG. 8 with selected stuffers removed. FIG. 9 illustrates batt material 20 on the paper supporting surface only and FIG. 10 illustrates batt material on both surfaces.

To place the woven fabric of the invention in service, it is fitted around the usual cylinders with the terminal ends 17 and 17', of FIG. 7, juxtapositioned. The end loops 12 and 12' are then intermeshed to form the pintle channel 15. The free ends of respective loops abut the stuffers of the opposite end. A pintle 13 is passed through the pintle channel 15 to interconnect the fabric ends. Although an optimum 90° anqle at the loops 12 and 12' maximizes the advantages of the invention, it is very difficult to obtain such complete control of the yarns. In practice, loops 12 and 12' which form a substantially vertical plane perpendicular to the horizontal plane of the fabric at about 90°±15° will provide the benefits of the invention.

With respect to actual construction of the fabric and the seaming loops, it is recognized that the fabric may be flat woven and the seaming loops formed through known loop forming techniques or back weaving or that the fabric be woven endless or circular with the loops be formed in the loom as part of the weaving process. These weaving techniques will be known to those skilled in the art. In the known techniques, a looping wire or similar device may be used to form the actual loop and to simulate the pintle location during weaving. In the present invention, the stuffers may be placed within the loop aperture during or after weaving in a known manner of applying stuffers to the woven fabric. If inserted during weaving, the stuffers are merely laid in the weave as it progresses on the loom without interweaving.

With reference again to FIG. 8, it will be appreciated that the batt 20 can be applied to the woven fabric through needling or the application of adhesives. When needling is utilized it will generally stabilize the location of the stuffers through intermingling of fibers. When adhesives are utilized which do not penetrate to the level of the stuffers, it is preferred to fix the stuffer by other means. For example, the stuffers may be retained relative to each other and the fabric by an adhesive. Likewise, the stuffers may be retained by application of a suitable material at the selvages of the fabric. Generally, papermakers fabric are subjected to heat setting and further processing which assist in stabilizing the fabric. The actual stabilizing method is subject to design considerations as will be known to those skilled in the art.

With respect to the yarns employed in the present invention, it is preferred to utilize continuous monofilament yarns. However, it is recognized that multi-filament yarns and cotton count yarns may be utilized. With respect to the stuffer yarns, it will be recognized that the stuffers may be of the same material as the remainder of the fabric or may be selected for certain characteristics. Those skilled in the art will recognize that stuffer yarns are often spun yarns or cotton count yarns which are selected to achieve certain characteristics of permeability and density in the seam area.

With respect to the yarn geometry, the present description has referred to circular yarns which may be generally described by their diameter or axis, see FIG. 3. However, shaped yarns may be utilized in the present invention.

With respect to the pintle, it will be understood by those skilled in the art that one or more pintles may be used and that the pintles are not required to bear a one to one relationship with the cross machine direction yarns.

Those skilled in the art will appreciate that the many modifications to the above described preferred embodiments may be made without departing from the spirit and scope of the invention.

What I claim is:

1. A seam construction for closing an open papermaker's fabric having a plurality of machine direction yarns interwoven with a plurality of cross machine direction yarns in a repeated pattern throughout the fabric length with each end of the fabric terminated with a plurality of machine direction loops, said seem construction comprised of:

each of said plurality of machine direction loops having a free end defined by a continuous arcuate portion of the machine direction yarn and a fixed end defined by an adjacent crossing portion of the said machine direction yarn as interwoven in the repeated pattern, said arcuate portion defining a vertical plane which is substantially perpendicular to the horizontal plane defined by said cross machine direction yarns;

said machine direction loops at each end of said fabric intermeshed to define a cross machine direction pintle channel, each of said loops having an internal aperture which has a longitudinal dimension equal to at least three times the average longitudinal dimension of the cross machine direction yarns and a vertical dimension no greater than the largest vertical dimension of a cross machine direction yarn;

a pintle in said pintle channel such that a cross machine direction stuffer channel is formed through the loops of at least one end of the fabric between the crossing segments of those loops and the free ends of the loops of the other fabric end which is at least the diameter of one cross machine direction yarn; and at least one cross machine direction stuffer positioned within said cross machine direction stuffer channel.

2. A seam construction for closing an open papermaker's fabric having a plurality of machine direction yarns interwoven with a plurality of cross machine direction yarns in a repeated pattern throughout the fabric length with each end of the fabric terminated with a plurality of machine direction loops, said seem construction comprised of:

each of said plurality of machine direction loops having a free end defined by a continuous arcuate portion of the machine direction yarn and a fixed end defined by an adjacent crossing portion of the said machine direction yarn as interwoven in the repeated pattern, said arcuate portion defining a vertical plane which is substantially perpendicular to the horizontal plane defined by said cross machine direction yarns;

said machine direction loops at each end of said fabric intermeshed to define a cross machine direction pintle channel, each of said loops having an internal aperture which has a longitudinal dimension equal to at least three times the average longitudinal dimension of the cross machine direction yarns and a vertical dimension no greater than the largest vertical dimension of a cross machine direction yarn;

a pintle in said pintle channel such that a cross machine direction stuffer channel is formed through the loops of at least one end of the fabric between the crossing segments of those loops and the free ends of the loops of the other fabric end which is at least the diameter of two cross machine direction yarn; and at least two cross machine direction stuffer positioned within said cross machine direction stuffer channel.

3. A method of producing seaming loops at the ends of a papermaker's felt having a woven base fabric, the method comprising the steps of:

providing a woven base fabric having a plurality of machine direction yarns extending from each end thereof;

forming seaming loops by extending machine direction yarns from the last crossover of the base weave to define an arcuate portion prior to reversing direction and weaving with the base fabric in a mirror image beginning at said crossover, each of said machine direction yarns forming an elongated loop having an internal aperture which has a longitudinal dimension equal to at least three times the average longitudinal dimension of the cross machine direction yarns;

determining the longitudinal dimension of the pintle which will be used to close said seam;

subtracting the longitudinal dimension of the pintle and the arcuate portion of the opposing seaming loop at the other end from the internal aperture to determine the free internal aperture within said loop;

inserting stuffers in sufficient quantity to substantially fill said free internal aperture; and meshing the seaming loops from the respective ends of said fabric to define a pintle channel and inserting a pintle therein.

* * * * *